US005696528A

United States Patent [19]

Yun

[11] Patent Number: 5,696,528

[45] Date of Patent: Dec. 9, 1997

[54] SUBWINDOW PROCESSING DEVICE BY VARIABLE ADDRESSING

[75] Inventor: Joo Hyun Yun, Seoul, Rep. of Korea

[73] Assignee: LG Electronics Inc., Seoul, Rep. of Korea

[21] Appl. No.: 575,486

[22] Filed: Dec. 20, 1995

[30] Foreign Application Priority Data

Mar. 9, 1995 [KR] Rep. of Korea ..... 4820/1995

[51] Int. Cl.[6] ..... G09G 5/14

[52] U.S. Cl. ..... 345/120; 345/119; 395/344

[58] Field of Search ..... 345/118–121; 395/157–166, 344

[56] References Cited

U.S. PATENT DOCUMENTS 5,025,249 6/1991 Seiler et al. ..... 340/721

5,047,755 9/1991 Morita et al. ..... 340/721

5,129,055 7/1992 Yamazaki et al. ..... 395/158

5,216,413 6/1993 Seiler et al. ..... 340/721

5,440,680 8/1995 Ichikawa et al. ..... 395/158

*Primary Examiner*—Richard Hjerpe

*Assistant Examiner*—David L. Lewis

[57] ABSTRACT

A subwindow processing device using variable addressing which does not perform conversion such as storing, backing up and copying directly accessing the data, but processes the generation and movement of a plurality of subwindows by accessing the subwindow data stored in memory according to subwindow variables. Therefore, since the load to the central processing unit and the data bus is reduced, a fast screen processing can be possible, and also, when being applied to a system requiring a fast screen shifting and to a multitasking system in which other functions such as voice data processing and communication data processing are performed along with the screen processing, the system performance can be enhanced.

21 Claims, 11 Drawing Sheets

$L_1 = 3$
$L_2 = 1$
$L_3 = 0$ $L_1 = 1$
$L_2 = 3$
$L_3 = 2$

SUBWINDOW PROCESSING DEVICE BY VARIABLE ADDRESSING

BACKGROUND OF THE INVENTION

The present invention relates to a device for displaying a subwindow, and more particularly to a subwindow processing device using variable addressing by which a plurality of subwindows can be displayed by accessing memory data according to variable addressing.

FIG. 1 is a schematic for explaining a conventional subwindow display method. Referring to the drawing, a central processing unit (not shown) generates a main window by accessing frame data in a display area stored in a memory. Next, a subwindow is displayed by accessing frame data stored in a subwindow area and converting the accessed frame data to display data.

Hereunder, a subwindow display method will be described referring to FIGS. 2 and 3.

First, as shown in FIG. 3, a central processing unit (not shown) sets through installation process a size of data to be displayed in a display area, and outputs a start address to display the main window on a screen (steps 10 and 12).

Then, in case of generating the subwindow, another start address is output after a size of frame data in the subwindow area and a position to be displayed are set through the installation process (steps 14 and 16).

As shown in FIG. 2A, to display the subwindow at a preset position, frame data stored in a memory area (D1) of the display area (D) is backed up into an additional memory area (M1). Then, as shown in FIG. 2B, the frame data in the subwindow area is converted to display data and stored in D1 so that the subwindow is displayed onto the main window (steps 18, 20 and 12).

In the meantime, when a subwindow-displaying status returns to a main window status, as shown in FIG. 2C, the frame data of the subwindow stored in D1 is backed up in an additional memory area (M2). Then, the frame data backed up in M1 is restored into D1, thus returning the main window status (steps 14, 22, 24 and 12).

Also, in case of moving the subwindow on the main window, as shown in FIG. 2D, the frame data of memory area (D2) corresponding to a position where the subwindow is to be moved is backed up into an additional memory area (M3). After the frame data of the subwindow area stored in D1 is copied into D2, the frame data backed up in M1 is restored into D1, thus moving the position of the subwindow.

However, since the conventional subwindow display method is performed by a CPU running a software program, considerable amount of load is imposed on the CPU and the data bus, thus, lowering, screen-processing speed. Thus, in case of a system where a fast screen shifting is required or a multitasking system in which other functions such as a processing of voice data or communication data is to be performed along with screen processing, the conventional method cannot provide an efficient user interface.

SUMMARY OF THE INVENTION

To solve the above problems, it is an object of the present invention to provide a subwindow processing device using variable addressing which displays a plurality of subwindows by accessing subwindow data stored in a memory according to the variable addressing so that embodying by hardware a subwindow displaying method which was performed by software is now embodied by hardware, and thus, reducing load to a data bus and a central processing unit and increasing screen processing speed.

Accordingly, to achieve the above object, there is provided a subwindow processing device using variable addressing comprising: a position counter for receiving horizontal and vertical pixel position values through the data bus and outputting incremented horizontal and vertical pixel position values corresponding to a currently counted pixel position by increasing a count of each pixel; a controller for receiving the horizontal and vertical pixel position values from the position counter, comparing the received values with variables of the subwindow inputed from the data bus, and outputting a main window enable signal, a subwindow enable signal and a subwindow layer value; a main window address generator for receiving main window enable signal from the controller and generating a main window address corresponding to a pixel to be displayed; a subwindow address generator for receiving subwindow enable signal from the controller and generating a subwindow address corresponding to a pixel to be displayed; and a decoder for respectively receiving the main window and subwindow addresses from the main window and subwindow address generators and selectively outputting each address according to the subwindow enable signal and the subwindow layer value.

These and other objects of the present application will become more readily apparent from the detailed description given hereinafter. However, it should be understood that the preferred embodiments of the invention are given by way of illustration only, since various changes and modification within the spirit and scope of the invention will become apparent to those skilled in the art from this detailed description.

BRIEF DESCRIPTION OF THE DRAWINGS

The above objects and advantages of the present invention will become more apparent by describing in detail a preferred embodiment thereof with reference to the attached drawings in which.

DETAILED DESCRIPTION OF THE INVENTION

Figure 1:
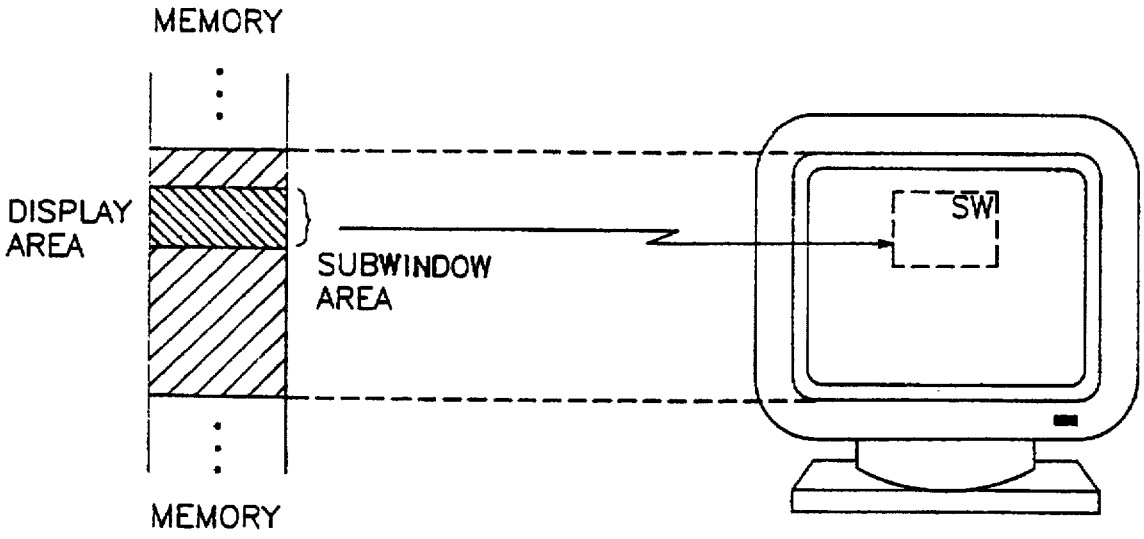
FIG. 1 CONVENTIONAL ART
FIG. 1 is a view illustrating a relation of a memory and a displaying screen in a conventional subwindow processing device.
Figure 2A:
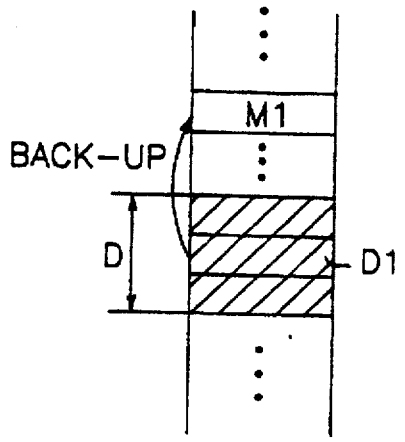
FIG. 2A CONVENTIONAL ART
FIGS. 2A, 2B, 2C, and 2D are view illustrating the generation, returning and moving of the subwindow of FIG. 1.
Figure 2B:
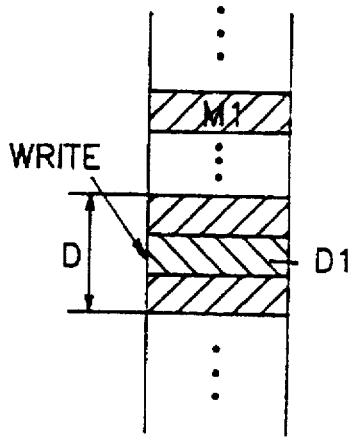
FIG. 2B CONVENTIONAL ART
Figure 2C:
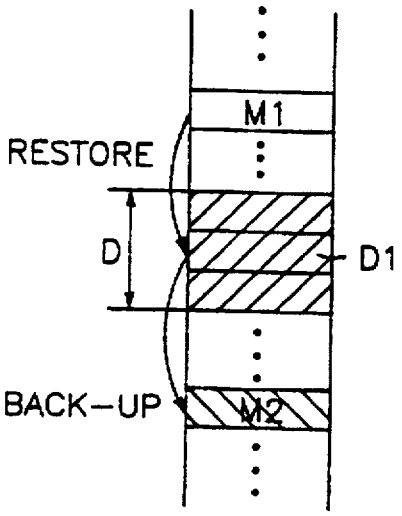
FIG. 2C CONVENTIONAL ART
Figure 2D:
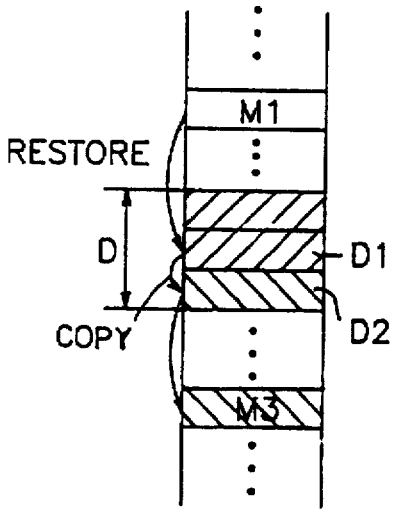
FIG. 2D CONVENTIONAL ART
Figure 3:
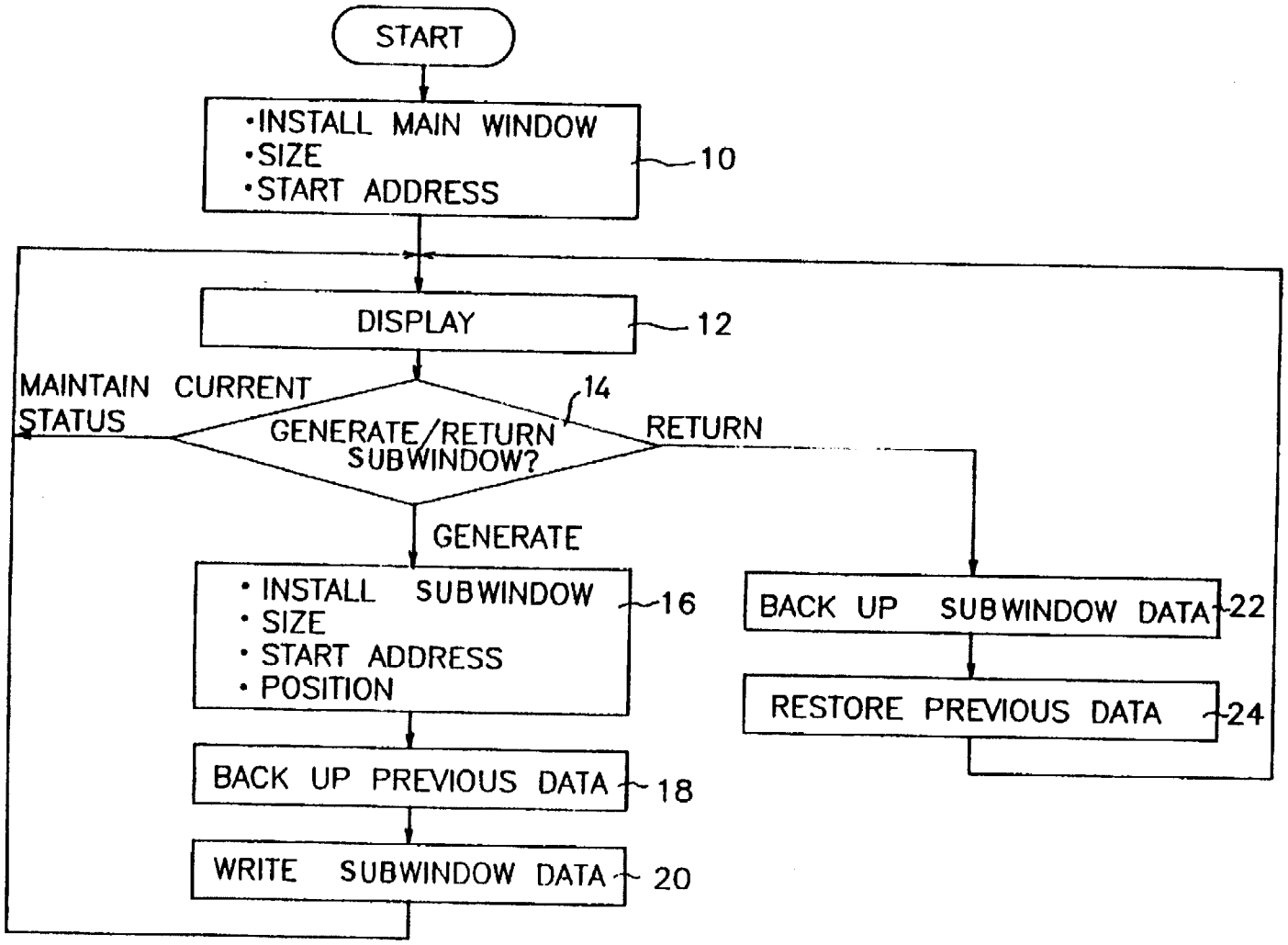
FIG. 3 CONVENTIONAL ART
FIG. 3 is a flowchart for explaining the generation and returning of FIG. 2.
Figure 4:
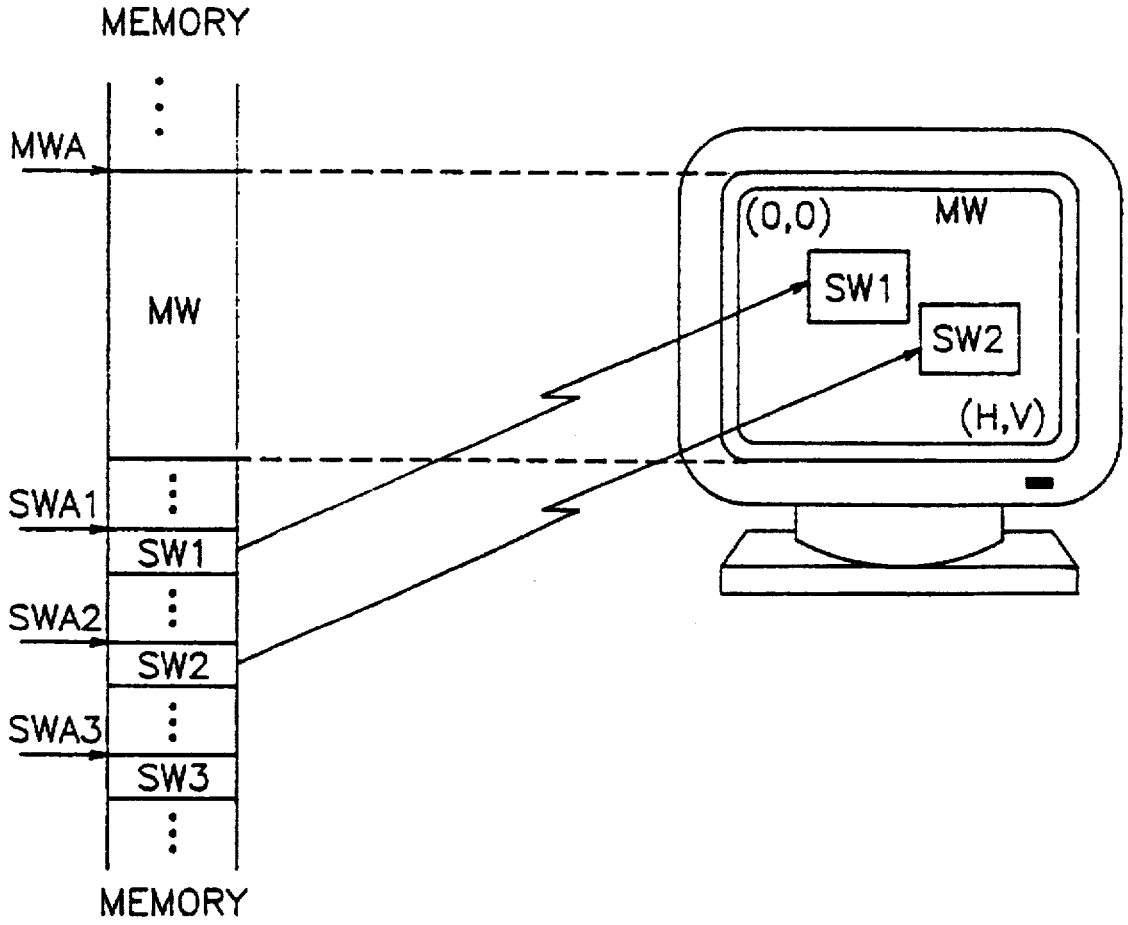
FIG. 4 is a view illustrating a relation of a memory and a displaying screen in a subwindow processing device using variable addressing according to present invention.
Figure 5:
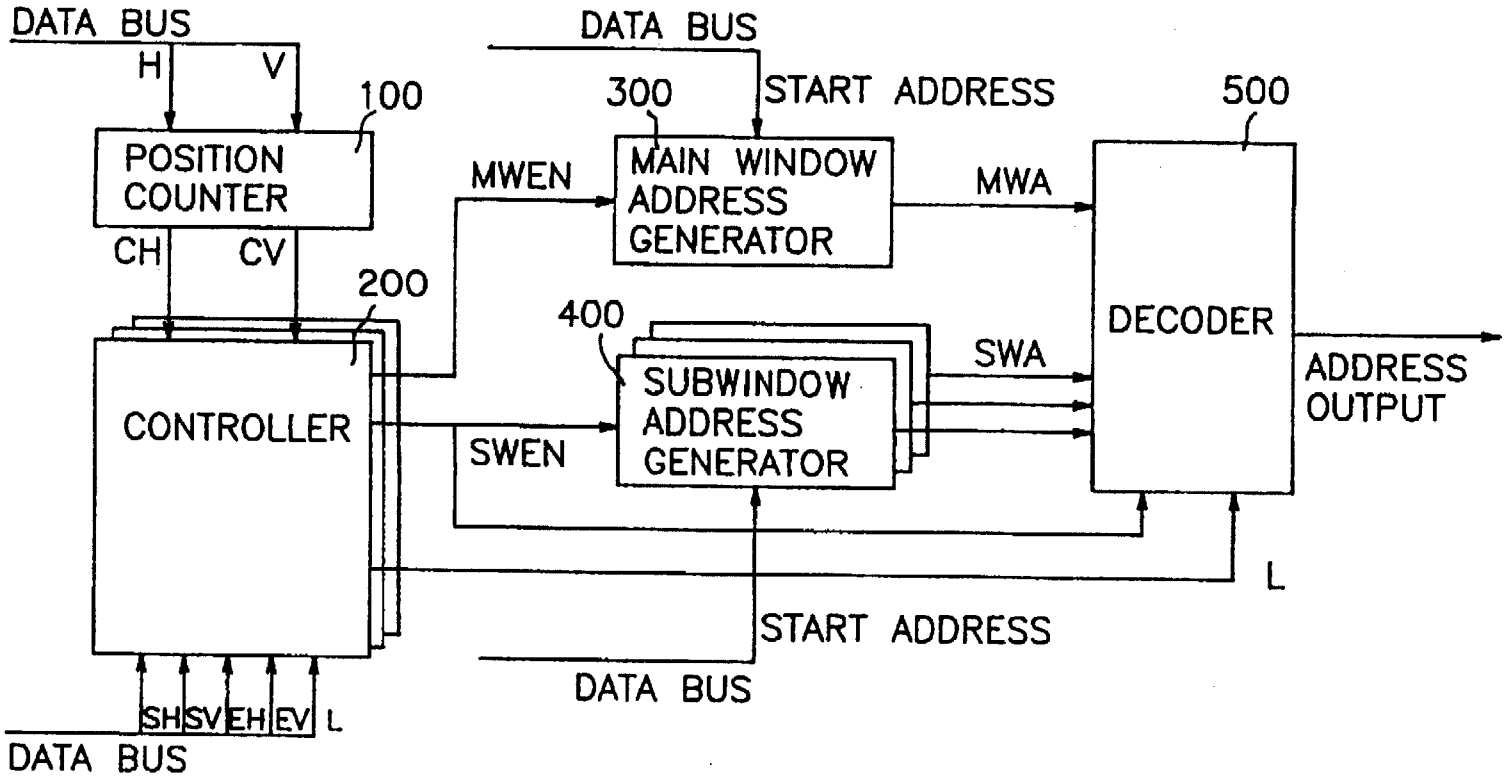
FIG. 5 is a block diagram of the subwindow processing device using variable addressing according to the present invention.

Referring to FIG. 5, the subwindow processing device using variable addressing according to the present invention comprises: i.e. horizontal and vertical pixel positions a position counter 100 for receiving horizontal and vertical size values H and V through the data bus and outputting incremented horizontal and vertical pixel positions values CH and CV corresponding to a currently counted pixel position by increasing a count of each pixel; a controller 200 for receiving the horizontal and vertical pixel positions values CH and CV from position counter 100, comparing the received values with variables of the subwindow inputed from the data bus, i.e., a horizontal start point SH, a vertical start point SV, a horizontal end point EH, a vertical end point EV, and a subwindow layer value L, and outputting a main window enable signal MWEN, a subwindow enable signal SWEN and subwindow layer value L; a main window address generator 300 for receiving main window enable signal MWEN from controller 200 and generating a main window address MWA corresponding to a pixel to be displayed; a subwindow address generator 400 for receiving subwindow enable signal SWEN from controller 200 and generating a subwindow address SWA corresponding to a pixel to be displayed; and a decoder 500 for respectively receiving the main window and subwindow addresses MWA and SWA from main window and subwindow address generators 300 and 400 and selectively outputting each address according to the subwindow enable signal SWEN and the layer value L.

FIG. 5 shows, for illustration purposes only, three layers of controller 200 corresponding to an equal number layers of subwindow address generator 400. However, it is apparent to those skilled in the art that there may be any number of controller 200 layers corresponding to an equal number of layers of subwindow address generators 400.

Figure 6:
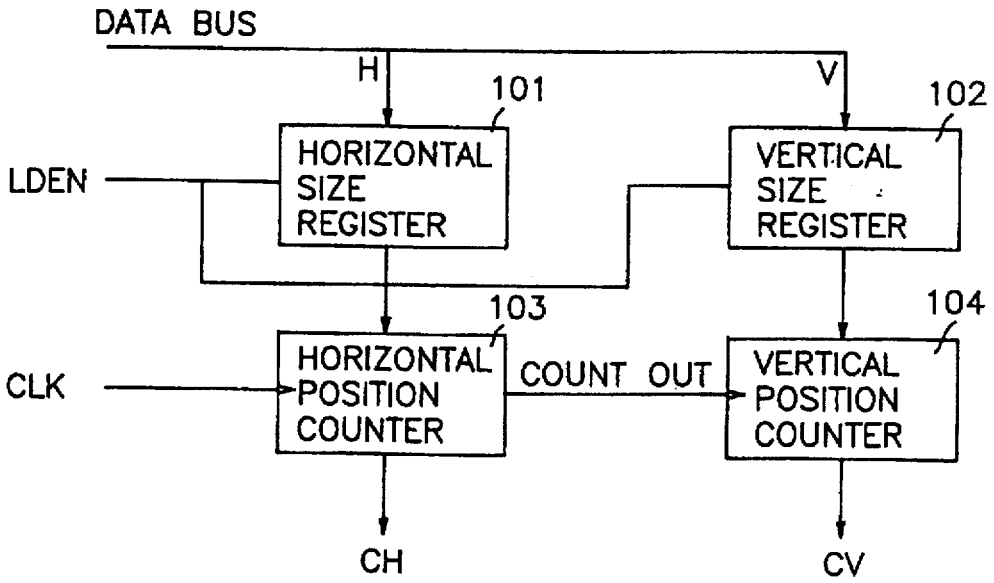
FIG. 6 is a detailed block diagram of the position counter of FIG. 5.

As shown in FIG. 6, position counter 100 comprises: horizontal and vertical size registers 101 and 102 for storing horizontal and vertical pixel position values H and V of the main window as a load enable signal LDEN is input from the system; and horizontal and vertical position counters 103 and 104 for receiving the horizontal and vertical pixel position values H and V from horizontal and vertical size registers 101 and 102 and outputting the incremented horizontal and vertical pixel position values CH and CV of a pixel position which is counted while a count increases every pixel according to a clock signal CLK.

Figure 7:
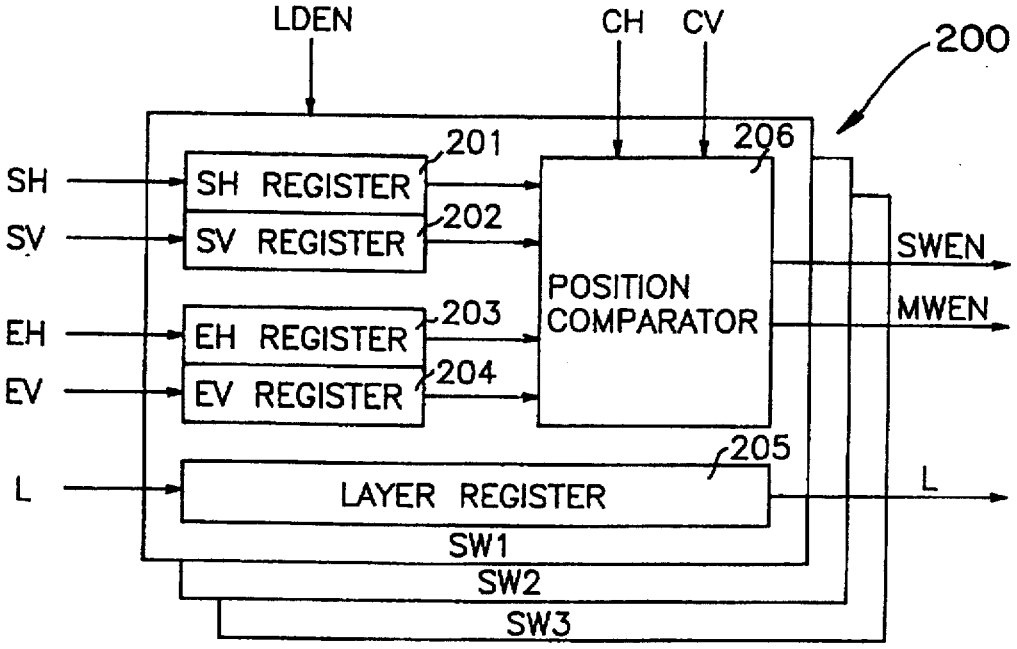
FIG. 7 is a detailed block diagram of the controller of FIG. 5.

As shown in FIG. 7, controller 200 comprises: an SH register 201, an SV register 202, an EH register 203, an EV register 204 and a subwindow layer register 203 for storing the variables of the subwindow, i.e., horizontal start point SH, vertical start point SV, horizontal end point EH, vertical end point EV, and subwindow layer value L, respectively, as the load enable signal LDEN is input from the system; and a pixel position comparator 206 for receiving the outputs of SH register 201, SV register 202, EH register 203, and EV register 204, comparing the received outputs with incremented horizontal and vertical size pixel position values CH and CV input from position counter 100, and outputting the main window enable signal MWEN and the subwindow enable signal SWEN.

Here, the number of controller 200 layers is determined according to the number of a subwindows sets (SW1, SW2, and so forth).

FIG. 7 shows, for illustration purposes only, three subwindow sets. However, it is apparent to those skilled in the art that there may be any number of subwindow sets.

Figure 8A:
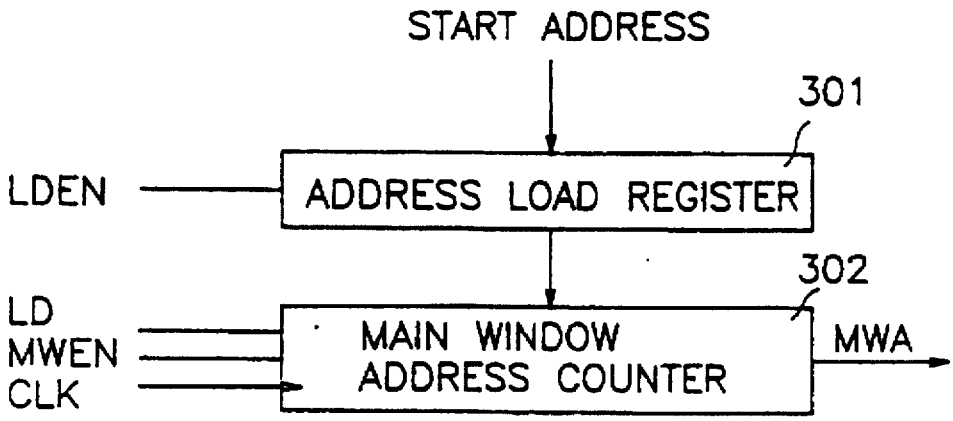
FIGS. 8A and 8B are detailed block diagrams of the a main window and subwindow address generators of FIG. 5.

Also, as shown in FIG. 8A, main window address generator 300 comprises: an address load register 301 for storing the start address as the load enable signal LDEN is input from the system; and a main window address counter 302 for receiving the main window enable signal MWEN output from controller 200, counting the start address output from address load register 301 and outputting the main window address MWA.

Figure 8B:
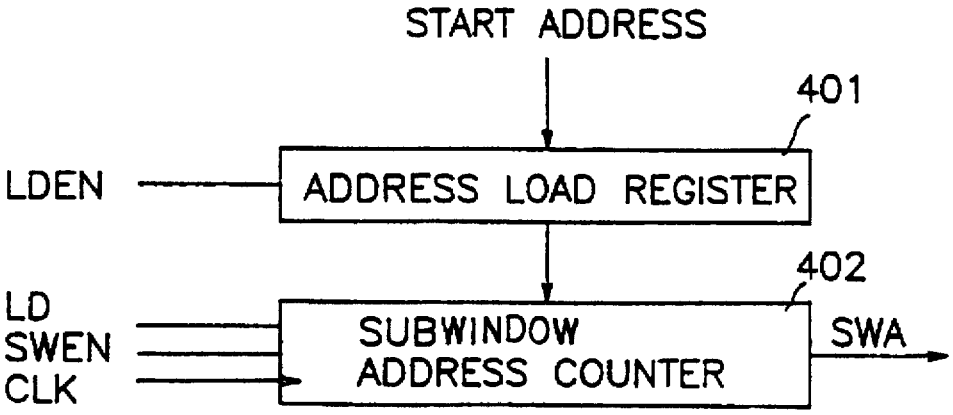

As shown in FIG. 8B, subwindow address generator 400 comprises: another address load register 401 for storing the start address as the load enable signal LDEN is input from the system; and a subwindow address counter 402 for receiving the subwindow enable signal SWEN output from controller 200, counting the start address output from address load register 401 and outputting the subwindow address SWA.

Here, the number of subwindow address generators 400 is determined according to the number of a subwindows set (SW1, SW2, and so forth).

Figure 9:
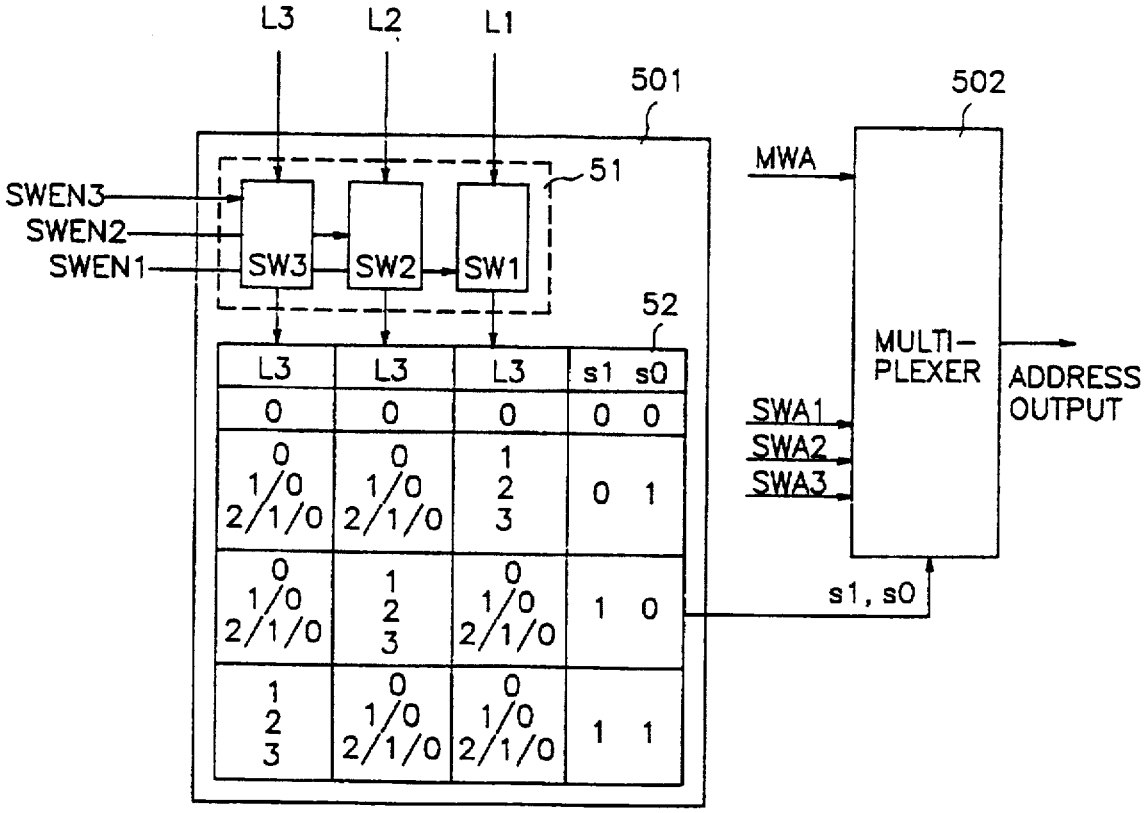
FIG. 9 is a detailed block diagram of the decoder of FIG. 5.

As shown in FIG. 9, decoder 500 comprises: a selection signal generator 501 for receiving the subwindow enable signals SWEN1 to SWEN3 and the subwindow layer value L1 to L3 and outputting a main window selection signal "s1" and a subwindow selection signal "s0"; and a multiplexer 502 for selectively outputting the main window address MWA and the subwindow address SWA according to the selection signals s1 and s0 output from selection signal generator 501.

Also, selection signal generator 501 comprises: a switching portion 51 for outputting one of the subwindow input layer values L1, L2, or L3 as the subwindow enable signals SWEN1, SWEN2, and SWEN3 is input from controller 200; and a mapping table 52 for outputting the selection signals s1 and s0 according to the subwindow layer value L output from switching portion 51.

Here, switching portion 51 consists of switches SW1 to SW3 the number of switches is equal to the number of the subwindows to be displayed.

The operation of the subwindow processing device using variable addressing according to the present invention will be described hereunder referring to the attached drawings.

First, when the horizontal and vertical pixel position values H and V of the main window are input through the data bus, horizontal and vertical size registers 101 and 102 store and output H and V, respectively, according to the load enable signal LDEN input from the system, as shown in FIG. 6.

Next, horizontal position counter 103 receives H and incremented horizontal pixel position value CH corresponding to the position of a currently counted pixel by increasing the count every displayed pixel according to clock signal CLK input from the system. When the counting from one line to H is over, horizontal position counter 103 outputs a count out signal to vertical position counter 104, and is cleared.

Also, vertical position counter 104 receives V and outputs the same vertical pixel position value CV when horizontal position counter 103 counts the one line to H. Then, when the count out signal is input from horizontal position counter 103, vertical position counter 104 increases CV.

That is, horizontal position counter 103 counts pixel positions of one line to the set H of the main window, and after counting is over, is cleared and simultaneously outputs the count out signal to vertical position counter 104 to increase by one the vertical size value of vertical position counter 104. Next, by repeating the counting action of the next one line to H, horizontal and vertical position counters 103 and 104 respectively output CH and CV corresponding to the position of the currently counted pixel position to controller 200.

Subsequently, as shown in FIG. 7, when the subwindow variables of (horizontal start point SH, vertical start point SV, horizontal end point EH, vertical end point EV, and subwindow layer value L) the size and position of the subwindow designated by an application program are input, SH register 201, SV register 202, EH register 203, and EV register 204 of controller 200 respectively store the subwindow variables and simultaneously output the stored variables to position comparator 206. Layer register 205 receives the subwindow layer value L and outputs the received value to decoder 500.

Then, position comparator 206 receives CH and CV each from horizontal and vertical position counters 103 and 104, and also receives SH, SV, EH and EV of the subwindow to be displayed from SH register 201, SV register 202, EH register 203, and EV register 204, respectively. When CH exists between SH and EH (SH≦CH≦EH) and CV exists between SV and EV (SV≦CV≦EV), SWEN is output. Except that case, MWEN is output.

Here, SWEN output from controller 200 is in proportion to the number of the subwindow set (SW1, SW2, and so forth).

In the meantime, when MWEN is output from controller 200, as shown in FIG. 8A, address load register 301 of main window address generator 300 stores and outputs the start address input through the data bus as LDEN is input from the system. Main window address counter 302 loads the start address from address load register 301 according to LD output from the system and performs the counting action according to CLK, and then, outputs MWA to multiplexer 502 of decoder 500 when MWEN is input.

However, when SWEN is input form controller 200, as shown in FIG. 8B, address load register 401 of subwindow address generator 400 stores and outputs the start address input through the data bus as LDEN is input from the system. Subwindow address counter 402 loads the start address from address load register 401 according to LD output from the system and performs the counting action according to CLK, and then, outputs MWA to multiplexer 502 of decoder 500 when SWEN is input.

Next, as shown in FIG. 9, switches SW1, SW2 and SW3 of switching portion 51 constructed in selection signal generator 501 respectively output subwindow layer values L1, L2 and L3 which are input being switched according to SWEN1, SWEN2 and SWEN3 output from position comparator 206 of controller 200. Mapping table 52 receives L1, L2 and L3 and outputs s1 and s0.

That is, the chance to select SW1 in mapping table 52 is that when L1 of SW1 is 1 and L2 and L3 of SW2 and SW3 are 0, when L1 of SW1 is 2 and L2 and L3 of SW2 and SW3 are 1 or 0, and when L1 of SW1 is 3 and L2 and L3 of SW2 and SW3 are 2 and, 1 or 0, s1 and s0 are 0 and 1.

The chance to select SW2 and SW3 are congruous with that of SW1.

Thus, multiplexer 502 receives SWA1, SWA2 and SWA3 output from subwindow address generator 400 and MWA output from main window address generator 300, and selectively outputs MWA and SWA1, SWA2 and SWA3 according to s1 and s0 output from mapping table 52.

That is, when s1 and s0 output from mapping table 52 are 0 and 0, multiplexer 502 outputs MWA, and when s1 and s0 is 0 and 1, 1 and 0 or 1 and 1, multiplexer 502 outputs SWA1, SWA2 and SWA3, respectively. Thus, multiplexer 502 accesses the subwindow data stored in the memory and the main window and the subwindow are displayed on the screen.

When the subwindow is overlapped, a subwindow having larger L has the priority to be displayed on the screen.

The displaying of the main window and the subwindows (SW1, SW2 and SW3) will be described with an example.

Figures 10A, 10B, 10C, 10D, 10E, 10F, 10G, 10H, 10I:
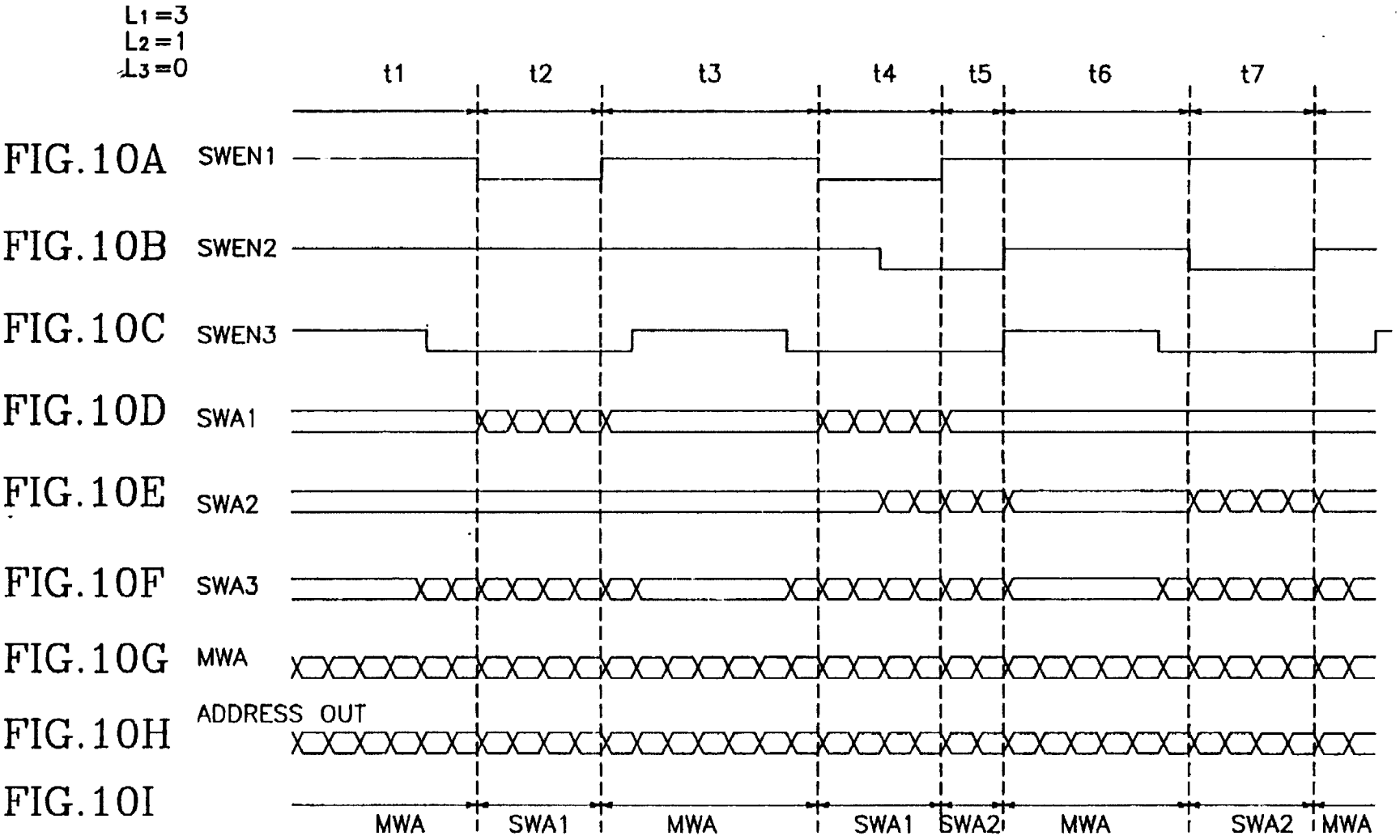
FIGS. 10A, 10B, 10C, 10D, 10E, 10F, 10G, 10H, and 10I are diagrams showing timing in processing of the decoder.

First, in FIG. 9, given L1, L2 and L3 input as SW1, SW2 and SW3 of selection signal generator 501 are set as 3, 1 and 0, respectively, and SWEN1, SWEN2 and SWEN3 are input as in FIGS. 10A though 10C.

Then, all of SW1, SW2 and SW3 turns off in section "t1" by SWEN1, SWEN2 and SWEN3 of a high level and Ls (layer values) of "0" are output. Accordingly, s1 and s0 of 0 and 0 respectively in mapping table 52 are output. Thus, multiplexer 502 outputs MWA as in FIG. 10G according to the above s1 and s0 of 0 and 0.

Figure 11A:
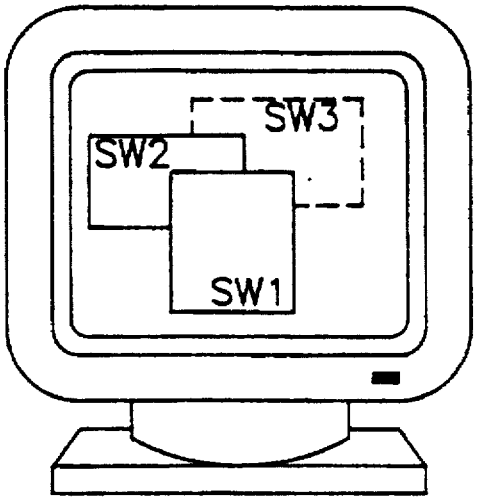
FIGS. 11A and 11B are views illustrating subwindows displayed on the screen according to the sequence of layer values when the subwindows are overlapped in the present invention.
Figure 11B:
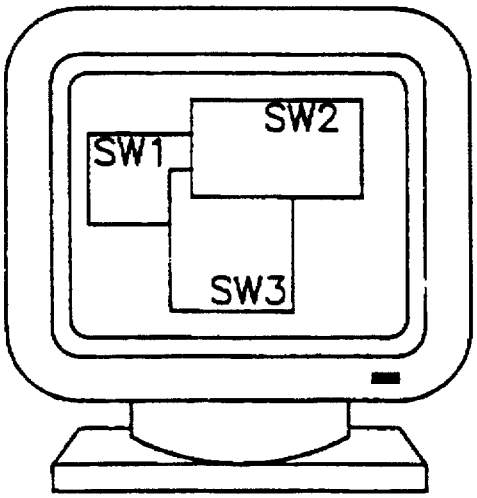

Subsequently, in section "t2," SW1 and SW3 are turned on by SWEN1 and SWEN3 of a low level and Ls of 3, 0 and 0 are output. Accordingly, s1 and s0 of 0 and 1 respectively in mapping table 52 are output. Thus, multiplexer 502 outputs MWA1 as in FIG. 10D according to the above s1 and s0 of 0 and 1 so that SW1 as shown in FIG. 11A is displayed.

In section "t3," all of SW1, SW2 and SW3 are turned off by SWEN1, SWEN2 and SWEN3 of a high level. Accordingly, since s1 and s0 of 0 and 0 respectively in mapping table 52 are output, multiplexer 502 outputs MWA as in FIG. 10G according to the above s1 and s0 of 0 and 0.

In section "t4," SW1 and SW3 are turned on by SWEN1 and SWEN3 of a low level and Ls of 3, 0 and 0 are output. Then, since SW2 is turned on by SWEN2 changing from the high level to the low level, Ls of 3, 1 and 0 are output. Thus, according to s1 and s0 output from mapping table 52, SW1 and SW2 become overlapped.

However, since L1 is greater than L2, mapping table 52 given with priority outputs s1 and s0 of 0 and 1, respectively. Multiplexer 502 outputs SWA1 as in FIG. 10D according to the above s1 and s0 of 0 and 1 to display SW1 as shown in FIG. 11A.

Next, in section "t5," SW2 and SW3 are turned on by SWEN2 and SWEN3 of a low level and Ls of 0, 1 and 0 are output. Then, mapping table 52 outputs s1 and s0 of 1 and 0, respectively. Multiplexer 502 outputs SWA2 as in FIG. 10E according to the above s1 and s0 of 1 and 0 to display SW2 as shown in FIG. 11A.

In sections "t6" and "t7," s1 and s0 are output in the same manner, and the main window and the subwindow are alternatively displayed according to the address output from multiplexer 502 by s1 and s0.

FIG. 9 shows, for illustration purposes only, three switches (SW1, SW2, SW3) with a corresponding number of subwindow enable signals (SWEN1, SWEN2, SWEN3) and a corresponding number of subwindow layer signals (L1, L2, L3). However, it is apparent to those skilled in the art that there may be any number of switches with a corresponding number of subwindow enable signals and subwindow layer signals.

FIG. 10B shows another example of the subwindow displayed on the screen according to the priority by the size of L. When L1 of SW1, L2 of SW2 and L3 of SW3 are respectively 1, 3 and 2, SW2, SW3 and SW1 are successively displayed according to the above-described process.

Figure 12:
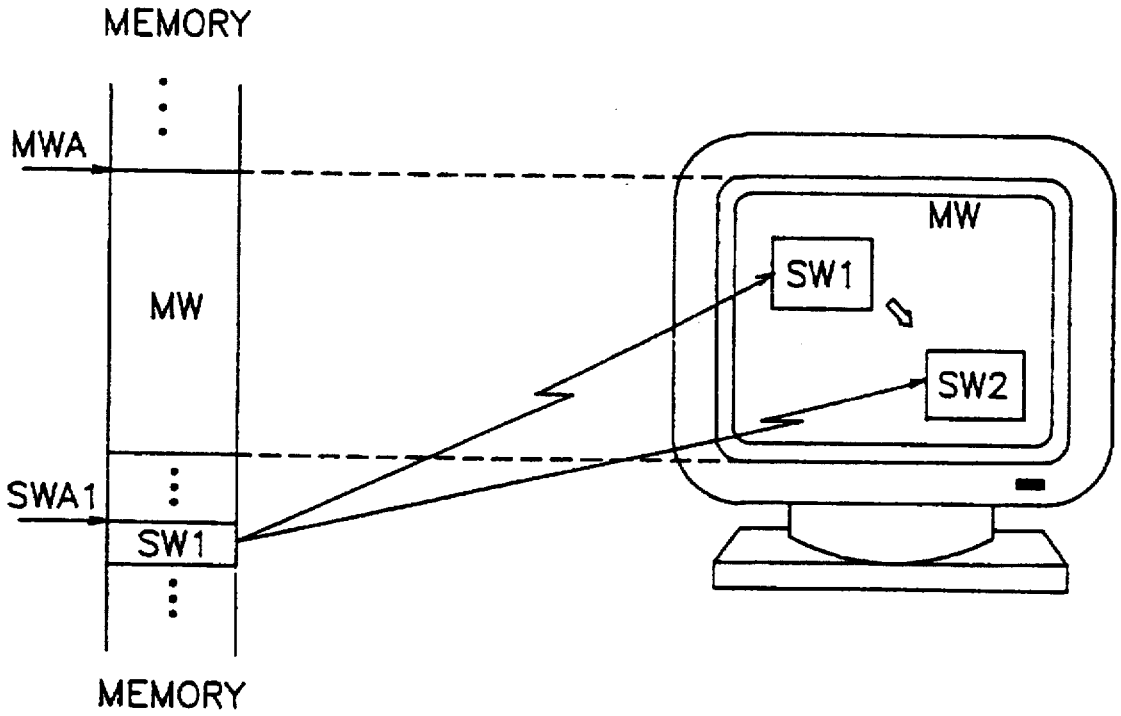
FIG. 12 is a view illustrating the movement of the subwindow in the present invention.

Meantime, when a position of SW1 is moved to a position of SW1' on the main window, as shown in FIG. 12, subwindow variables SWA1, SH1, SV1, EH1, EV1 and L1 with respect to the area of the subwindow are set in an application program and SW1 is displayed. Then, the position of the subwindow can be easily moved by setting variables SH1', SV1', EH1', EV1' and L1' of SW1' to be moved.

As described above, the present invention does not perform data conversion such as storing, backing up and copying by directly accessing the data, but processes the generation and movement of a plurality of subwindows by accessing the subwindow data stored in the memory according to the varying address. Therefore, since the load to the central processing unit and the data bus is reduced, a fast screen processing can be possible, and also, when being applied to a system requiring a fast screen shifting and to a multitasking system in which other functions such as voice data processing and communication data processing are performed along with the screen processing, the system performance can be enhanced.

What is claimed is:

1. A subwindow device using variable addressing comprising:

a position counter for receiving horizontal and vertical pixel position values (H,V) through a data bus and outputting incremented horizontal and vertical pixel position values (CH, CV) corresponding to a currently counted pixel position by increasing a position count of each pixel;

at least one controller, each controller receiving the incremented horizontal and vertical pixel position values from said position counter, comparing the received pixel position values with subwindow variables of a subwindow input from the data bus, and outputting a main window enable signal, a subwindow enable signal and a subwindow layer value signal;

a main window address generator for receiving the main window enable signal from said at least one controller and generating a main window address corresponding to pixels to be displayed;

at least one subwindow address generator, each subwindow address generator for receiving the subwindow enable signal from said at least one controller and generating a subwindow address corresponding to pixels to be displayed; and a decoder for respectively receiving the main window and subwindow addresses from said main window and subwindow address generators and selectively outputting each address according to the subwindow enable signal and the subwindow layer value.

2. The subwindow processing device using variable addressing according to claim 1, wherein said variables of the subwindow consist of a horizontal start point value (SH), vertical start point value (SV), a horizontal end point value (EH), a vertical end point value (EV), and a subwindow layer value L.

3. The subwindow processing device using variable addressing according to claim 1, wherein said controller and said subwindow address generator are set as to a number of said subwindows to be displayed.

4. The subwindow processing device using variable addressing according to claim 2, wherein said subwindow variables of said subwindow are variably set when said subwindow is moved.

5. The subwindow processing device using variable addressing according to claim 1, wherein said position counter includes:

horizontal and vertical pixel position registers for storing said horizontal and vertical size pixel position values of said main window as a load enable signal is input from a system; and horizontal and vertical position counters for receiving said horizontal and vertical pixel position values from said horizontal and vertical size registers and outputting incremented horizontal and vertical pixel position values of a pixel position which is counted while a count increases every pixel according to a clock signal.

6. The subwindow processing device using variable addressing according to claim 5, wherein said horizontal position counter outputs a count out signal to said vertical position counter to increase by one said vertical pixel position value of said vertical position counter after counting pixels of one line to the horizontal size value is over, and then, is cleared.

7. The subwindow processing device using variable addressing according to claim 1, wherein said controller includes:

a horizontal start point (SH) register, a vertical start point (SV) register, a horizontal end point (EH) register, a vertical end point (EV) register, and a subwindow layer register for storing subwindow variables, while said load enable signal is input from said system; and a position comparator for receiving the outputs of said SH register, said SV register, said EH register, and said EV register, comparing the received outputs with said horizontal and vertical pixel position values input from said position counter, and outputting said main window enable signal and said subwindow enable signal.

8. The subwindow processing device using variable addressing according to claim 7, wherein when said horizontal pixel position value exits between said horizontal start point and said horizontal end point ($SH \leqq CH \leqq EH$) and said vertical pixel positions value exists between said vertical start point and said vertical end point ($SV \leqq CV \leqq EV$), said subwindow enable signal is output.

9. The subwindow processing device using variable addressing according to claim 1, wherein said main window address generator includes:

an address load register for storing said start address as said load enable signal is input from said system; and a main window address counter for receiving said main window enable signal output from said controller, counting said start address output from said address load register and outputting said main window address.

10. The subwindow processing device using variable addressing according to claim 9, wherein said main window address counter performs the counting action when there is no input of said main enable signal.

11. The subwindow processing device using variable addressing according to claim 1, wherein said subwindow address generator includes:

another address load register for storing said start address while said load enable signal is input from said system; and a subwindow address counter for receiving said subwindow enable signal output from said controller, counting said start address output from said address load register and outputting said subwindow address.

12. The subwindow processing device using variable addressing according to claim 11, wherein said subwindow address counter performs counting only when said subwindow enable signal is input.

13. The subwindow processing device using variable addressing according to claim 1, wherein said decoder includes:

a selection signal generator for outputting a selection signal of a main window and subwindow; and a multiplexer for selectively outputting a main window address and subwindow address according to the selection signal output from said selection signal generator when said subwindow enable signal and subwindow layer value are input from said controller.

14. The subwindow processing device using variable addressing according to claim 13, wherein said selection signal generator includes:

a switching portion for outputting said subwindow layer value input which being switched by said subwindow enable signal; and a mapping table for outputting a selection signal according to said subwindow layer value output from said switching portion.

15. The subwindow processing device using variable addressing according to claim 14, wherein said switching portion is constructed as to a number of subwindow sets.

16. A method of addressing subwindow data using variable addressing, comprising the steps of:

counting horizontal and vertical pixel position values for pixels to be displayed and outputting incremented horizontal and vertical pixel position values;

comparing the incremented horizontal and vertical pixel position values with subwindow variables for a subwindow;

outputting a subwindow layer value along with either a main window enable signal or a subwindow enable signal based on the comparison result;

generating, in response to said main window enable signal and subwindow enable signal, a main window address and a subwindow address initiated by said main window enable signal and subwindow enable signal, respectively; and selectively outputting one of either the main window address or the subwindow address based on the subwindow enable signal and the subwindow layer value.

17. The method of claim 16, further comprising the step of:

setting new subwindow variables for new pixel position values when a subwindow moves to a new position.

18. The method of claim 16, including the step of:

using a mapping table to select between the main window address and the subwindow address.

19. A subwindow processing device for displaying subwindows based on a subwindow layer value, comprising:

a position counter for incrementing horizontal and vertical pixel position values input thereto;

at least one controller, each controller comparing the incremented horizontal and vertical pixel position values with subwindow variables of the subwindow for generating a main window address and a subwindow address, and outputting a subwindow layer value and first and second enablement signals;

a main window address generator for generating the main window address based on the first enablement signal;

at least one subwindow address generator for generating the subwindow address based on the second enablement signal;

a decoder for receiving the subwindow layer value signal and the second enablement signal and selectively outputting either one of the main window address or the subwindow address.

20. The subwindow processing device of claim 19, wherein said decoder further comprises:

a switch for outputting the subwindow layer value signal input which is being switched by said second enablement signal.

21. The subwindow processing device of claim 14, wherein said mapping table uses the subwindow layer value outputted by the switching portion to generate selection signals to output the main window address and the subwindow address.

* * * * *